United States Patent [19]

Tupes

[11] Patent Number: 5,076,492

[45] Date of Patent: Dec. 31, 1991

[54] CARTON HAVING INTEGRAL, REMOVABLE PLATFORM

[75] Inventor: William C. Tupes, Pepper Pike, Ohio

[73] Assignee: General Electric Company, Schenectady, N.Y.

[21] Appl. No.: 676,147

[22] Filed: Mar. 27, 1991

[51] Int. Cl.[5] ..... B65D 5/48

[52] U.S. Cl. ..... 222/120.21

[58] Field of Search ..... 229/120.06, 120.15, 229/120.19, 120.21, 120.28, 120.32

[56] References Cited

U.S. PATENT DOCUMENTS

| | | | |
|---|---|---|---|
| 519,005 | 5/1894 | Reeves, Jr. | 229/120.06 |
| 1,352,759 | 9/1920 | Markert | 229/120.21 |
| 2,142,131 | 1/1939 | Inman | 229/120.21 |
| 2,184,854 | 12/1939 | Spooner | 229/120.32 |
| 2,265,664 | 12/1941 | Markett . | |
| 2,784,839 | 3/1957 | Omer, Jr. . | |
| 2,946,498 | 7/1960 | Williamson . | |
| 3,965,803 | 6/1976 | Stone | 229/120.06 |
| 4,236,662 | 12/1980 | Roccaforte . | |
| 4,274,578 | 6/1981 | Montealegre | 229/120.21 |
| 4,320,830 | 3/1982 | Roccaforte | 206/45.19 |
| 4,396,115 | 8/1983 | Watson | 229/120.06 |
| 4,836,383 | 6/1989 | Gordon et al. | 206/611 |
| 4,957,237 | 9/1990 | Madonna et al. | 229/120 |

FOREIGN PATENT DOCUMENTS

| | | | |
|---|---|---|---|
| 689810 | 6/1964 | Canada | 229/120.06 |

*Primary Examiner*—Gary E. Elkins

*Attorney, Agent, or Firm*—Edward M. Corcoran; Stanley C. Corwin; Fred Jacob

[57] ABSTRACT

A rectangular carton for shipping articles such as incandescent light bulbs and serving as a display base for the articles is formed from a unitary boxboard blank and has an integral, removable platform or false bottom within. This enables the carton to be of a sufficient height to serve as a base to display the articles and at the same time permits shipment of a quantity of articles substantially less than what the carton will hold without the need for fillers or extra packing materials.

3 Claims, 2 Drawing Sheets

CARTON HAVING INTEGRAL, REMOVABLE PLATFORM

FIELD OF THE INVENTION

The present invehtion relates to a rectangular carton having an integral, removable tray or false bottom within for storing and shipping articles and also for serving as a display base for displaying the articles removed from within. It is preferred that the carton, including the false bottom, be formed from a unitary boxboard or cardboard blank.

SUMMARY OF THE INVENTION

The present invention relates to a carton having a plurality of side walls which form a rectangular tube and an integral, removable platform within which is spaced apart from the top and bottom of the carton and which is disposed generally parallel to said bottom. The platform extends from one side panel to an opposite and opposing side panel. More particularly, the present invention relates to a rectangular carton having two pairs of opposite and opposing side panels, a top, a bottom and an integral, removable platform within. The platform, which is spaced apart from and generally parallel to the bottom of the carton, extends from one side panel to an opposite side panel and is supported at each end by a hingedly attached flap, at least one of which is attached only to the platform and which extends to the bottom of the carton. The other flap is detachably attached to the interior portion of the carton. In a particularly preferred embodiment, the carton of the present invention will be formed from a unitary boxboard blank and the detachably attached flap will be an integral part of the blank. A carton of the present invention is useful as a container for shipping, storing and displaying trays of incandescent lamps.

DETAILED DESCRIPTION

Figure 1:
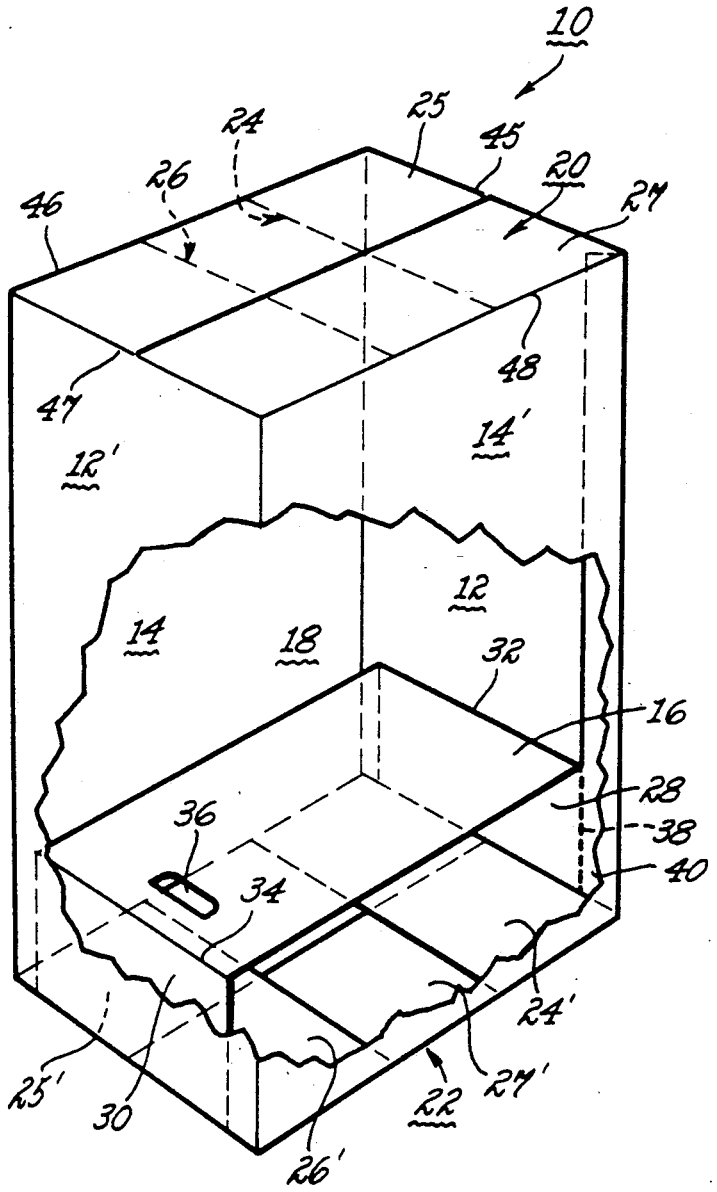
FIG. 1 is a perspective view in partial cut-away and phantom form illustrating a carton of the present invention.

Referring to FIG. 1, carton 10 is shown as a rectangular shaped carton consisting of two pairs of opposing, opposite and parallel side panels 12, 12' and 14, 14' containing integral panel 16 within and defining space 18 for shipping and storing articles (not shown). Top and bottom 20 and 22 of carton 10 are each formed from two pairs of glue flaps 24–26, 25–27, and 24'–26', 25'–27', respectively, in a conventional manner as is well known to those skilled in the art. Platform 16 is offset from and parallel to bottom 22 and it is held in place by flaps 28 and 30 which are hingedly connected to platform 16 by means of fold lines 32 and 34, respectively. Platform 16 also contains a hand hole 36 cut out therefrom to facilitate removal of the platform from the carton via perforations 38 when removing articles contained therein. Panel or flap 28 which is hingedly attached to and which forms a part of platform 16 along fold line 32 is attached to glue flap 40 along perforations 38.

Figure 2:
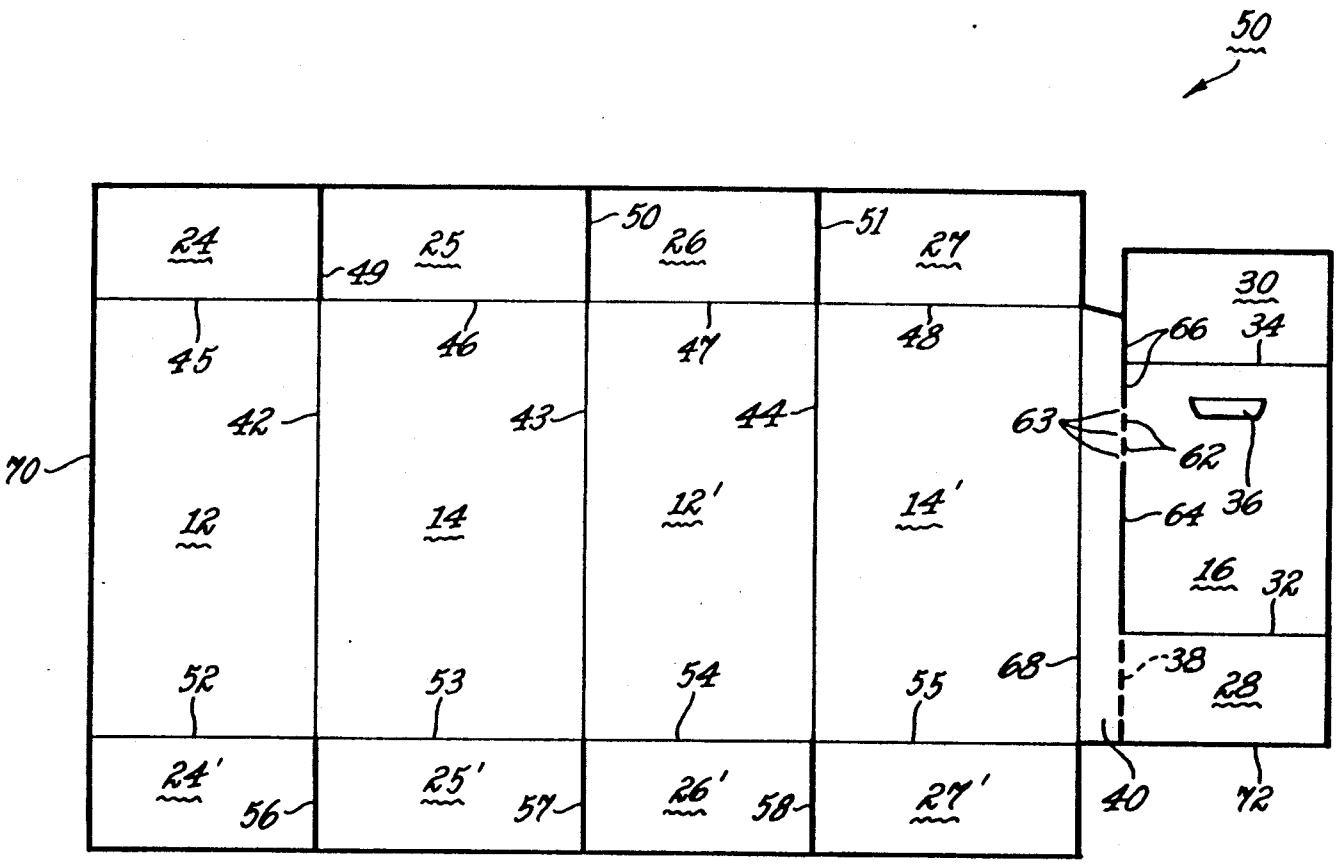
FIG. 2 is a schematic plan view of a boxboard blank from which the carton illustrated in FIG. 1 is constructed.

Turning now to FIG. 2 there is shown unitary boxboard blank 50 comprising a series of six consecutively arranged, generally rectangular shaped panels, hingedly connected along parallel fold lines. The series comprises panels 12, 14, 12' and 14' forming the four sides of carton 10 which are sequentially hingedly connected along parallel fold lines 42, 43 and 44. Top flaps 24, 25, 26 and 27 depend from panels 12, 14, 12' and 14' along fold lines 45, 46, 47 and 48, respectively. Cut or score lines 49, 50 and 51 enable separate folding and manipulation of the top flaps for forming top 20. Similarly, bottom flaps 24', 25', 26' and 27' hingedly depend from panels 12, 14, 12' and 14' along fold lines 52, 53, 54 and 55, respectively. Cut or score lines 56, 57 and 58 form the four separate end flaps for forming bottom 22. Platform 16 along with its pair of end flaps 28 and 30 which depend therefrom along fold lines 32 and 34, respectively, is detachably attached to glue flap 40 by perforations 38 and three small, uncut sections of boxboard 63 formed by cooperation of two cuts 62 with score or cut lines 64 and 66. Glue flap 40, in turn, is hingedly connected to panel 14' along fold line 68. The three small uncut boxboard segments 63 bridging platform 16 and glue flap 40 along cut or score lines 64 and 66 enable boxboard blank 50 to be handled and assembled into carton !0 with platform 16 detachably attached along said cut or score lines 64 and 66 to glue flap 40.

In forming carton 10, side walls 12, 14, 12' and 14' are folded along fold lines 42, 43 and 44 and glue flap 40 is folded along fold line 68 with that portion of panel 12 adjacent edge 70 being glued to glue flap 40 to form the rectangular carton. Rectangular is also meant to include square. Panels 24', 26' and 25', 27' are then folded toward each other and glued in a conventional manner to form bottom 22. Then platform flap 30 is folded down along fold line 34 and platform 16 is pulled away from panel 12 and glue flap 40 and pushed down, thereby breaking the three small bits of uncut boxboard 63 bridging score lines 64 and 66 and bending along fold line 32. Platform 16 is supported generally parallel to, but disposed from bottom 22 via its end flaps 28 and 30 and is generally perpendicular to the side walls of the carton. The articles are placed in cavity 18 formed by the space between the upper portion of platform 16 and the top edge of the carton defined by fold lines 45, 46, 47 and 48, as shown in FIG. 1, after which the top is closed by bending in and gluing the two pairs of opposing end flaps 24–26 and 25–27 in the conventional and well known manner to seal the carton and form top 20.

In using the carton of the invention for storing, shipping and displaying articles such as trays of incandescent lamps, the bottoms of the trays of lamps are inserted facing bottom 22 and rest on panel 16. In opening carton 10, the carton first is turned upside down with top 20 now resting on a floor or suitable support and bottom 22 opened by means of opening the two pairs of opposing glue flaps 25'–26, and 24'–27, Platform or false bottom 16 is then removed by inserting a hand into hand hole 36 and pulling generally upwards which rips flap or panel 28 from glue flap 40 along perforations 38. Flap 28 is removed along with platform 16 and flap 30 in order that the trays of products may be easily removed from carton 10. After platform 16 with its pair of opposing end flaps 28 and 30 has been removed from carton 10, a hand is placed on the bottom-most tray of lamp-containing trays (not shown) in space 18 for support and the carton is then turned right side up and gently pulled off the trays of lamps. Bottom end flaps 24', 25', 26', and 27, are then refolded and carton 10 placed upright with top 20 again facing up. The trays of lamps are placed on the top 20 of carton 10. Empty carton 10 then serves as a display base for the trays of lamps. The false bottom or panel permits use of a carton having an overall height sufficient to serve as a display base for the product contained within and at the same time store and ship less than the quantity of articles which the carton would otherwise hold.

In one particular embodiment useful for shipping, storing and displaying incandescent lamps, a carton has been made wherein all of the side panels 12, 14, 12' and 14' are about 23 inches high. Opposing side panels 12 and 12' are approximately 12 inches wide with panels 14, 14' being approximately $14\frac{1}{4}$ inches wide. Glue flap 40 is $1\frac{1}{4}$ inches wide with platform or false bottom 16 being $13\frac{7}{8}$ inches long and $9\frac{3}{8}$ inches wide. Opposing end panels 18 and 20 are each $9\frac{3}{8}$ by $5\frac{3}{4}$ inches. All of the end flaps, both top and bottom, are 5-5/16 inches long. Perforations 38 are formed of $\frac{5}{8}$ inch perforations for a distance of $5\frac{3}{4}$ inches, or from edge 72 to fold line 32. The three uncut sections 63 are located about $2\frac{3}{4}$ inches from fold line 34 and are each 1/16 inch long. Hand hole 36 is approximately 3 inches by 1 inch.

What is claimed is:

1. A carton having two pairs of opposite and opposing side panels, a top and a bottom, a glue flap and an integral, removable platform within, said platform being spaced apart from both said top and bottom, disposed generally parallel to said bottom and extending from one of said side panels to an opposite and opposing said side panel, said platform further having a pair of opposite and opposing end flaps depending from said platform and disposed towards said bottom for supporting said platform with one of said end flaps being detachably attached to said glue flap within said carton.

2. A rectangular carton formed from a unitary boxboard blank, said carton having two pairs of opposite and opposing side panels, a glue flap interior of said carton a top, a bottom and an integral, removable platform within which is spaced apart from and generally parallel to said bottom and extends from one of said side panels to an opposite side panel and is supported at opposite ends by a hingedly attached flap both of which depend from and are perpendicular to said platform at least one of which extends to said bottom, with the other said flap being detachably attached to said glue flap.

3. A unitary blank adapted to be formed into a rectangular shaped carton said blank comprising a series of five consecutively arranged, generally rectangular shaped panels hingedly connected along parallel fold lines, said series comprising:

a first and a third panel for forming a front and a back, respectively, of said carton;

a second and a fourth panel for forming opposing sides of said carton, and a fifth panel connected to said fourth panel, said fifth panel comprising a glue flap portion hingedly connected at said fourth panel along oen of said fold lines and a platform portion detachably attached to and depending from said glue flap portion, wherein said platform portion comprises a platform panel with an end flap on each end hingedly connected to said platform panel wherein one of said end flaps is detachably attached to said glue flap along an edge generally parallel to the longitudinal axis of said glue flap and generally perpendicular to said fold line which hingedly connects said flap to said platform panel.

* * * * *